United States Patent [19]

Sendzimir et al.

[11] Patent Number: 4,505,438

[45] Date of Patent: Mar. 19, 1985

[54] SINGLE COIL ACCUMULATOR

[75] Inventors: Tadeusz Sendzimir, Waterbury; Jacek Z. Gajda, Woodbury, both of Conn.

[73] Assignee: Sendzimir Engineering Corporation, Waterbury, Conn.

[21] Appl. No.: 598,200

[22] Filed: Apr. 9, 1984

Related U.S. Application Data

[63] Continuation-in-part of Ser. No. 468,688, Feb. 22, 1983, abandoned.

[51] Int. Cl.[3] ..... B65H 17/42; B65H 17/48

[52] U.S. Cl. ..... 242/55; 242/78.1; 242/78.7

[58] Field of Search ..... 242/55, 55.16, 55.17, 242/55.21, 78.1, 78.6, 78.7, 63

[56] References Cited

U.S. PATENT DOCUMENTS

| | | | |
|---|---|---|---|
| 3,273,814 | 9/1966 | Prusak et al. | 242/55 |
| 3,782,662 | 1/1974 | Miller | 242/78.1 X |
| 4,012,005 | 3/1977 | Hattersley, Jr. | 242/55 |
| 4,163,527 | 8/1979 | Hood et al. | 242/55 |

OTHER PUBLICATIONS

Guild Shearwelders for Welding, p. 10, 2/22/83.

*Primary Examiner*—Stuart S. Levy
*Assistant Examiner*—Lloyd D. Doigan
*Attorney, Agent, or Firm*—Samuel Lebowitz

[57] ABSTRACT

A high capacity single coil strip accumulator for transient storage of longitudinally advancing metallic or other strip material usually supplied in coils which must be welded end-to-end to form a continuous web which is to be fed at uninterrupted speed to downstream processing equipment, e.g., annealing.

The single revolving accumulator coil is characterized by a variable number of convolutions and variable inner and outer diameters, with provision for continuously paying out of strip from its outer convolution, while intermittently adding new strip to its inner convolution. An independently rotatable cage with an axially locatable uncoiler for paying-off strip from a supply coil to said inner convolution has affixed thereto a joining device such as a butt welder, in the path of the strip from the uncoiler to the inner convolution. Upon the exhaustion of the strip from the supply coil, the tail end thereof is automatically gripped in the exit vise of the welder, and the latter with the cage rotate together with the accumulator coil until welding the leading end of a next supply coil to said tail end of said strip is completed. This causes partial depletion of the accumulator coil which is subsequently replenished by feeding strip from the newly joined supply coil at a higher speed than the payout speed. The invention is adaptable to an accumulator coil rotating on either a horizontal or vertical axis.

21 Claims, 15 Drawing Figures

SINGLE COIL ACCUMULATOR

This application is a continuation-in-part of our pending application Ser. No. 468,688, filed Feb. 22, 1983, now abandoned.

The invention relates to a method and apparatus for intermediate storage of a variable length of strip material and, in particular, to the accumulation of metallic or other strip material, for example, as used in steel strip annealing lines.

BACKGROUND OF THE INVENTION

While various accumulating devices have hitherto been proposed which may be operated with an intermittent input and continuous output, such devices are relatively complex and generally comprise one of two kinds of prior art strip accumulators.

The first type of accumulating device is exemplified in U.S. Pat. No. 3,258,212, issued June 28, 1966 to Harry LaTour. According to the method disclosed in this patent, the strip is stored in a coil having a constant number of convolutions. When the supply to the coil is interrupted, the rotating table is stopped, but the strip continues to be paid off from the inside of the coil which is in an expanded condition, i.e., spaced outwardly from the roll cage. As this paying off continues, the convolutions collapse inwardly against the roll cage. The action of the storage coil is in effect a cyclic tightening and loosening without a change in the number of turns in the coil. One obvious disadvantage of this method is the relative scraping movement between adjacent convolutions which can produce unacceptable scratches of the surface of the strip material.

The second type of prior art "looping" accumulator is described in U.S. Pat. No. 3,310,255, issued Mar. 21, 1967 to Tadeusz Sendzimir. The device described in this patent stores the strip in two coaxial spiral coils, one of them being wound clockwise and the other counterclockwise, with their inner portions being joined by a transition curve to form a continuous strip length.

Other prior art patents of interest include U.S. Pat. Nos. 3,506,210, issued Apr. 14, 1970 to Harry LaTour; 3,885,748, issued May 27, 1975 to Anthony C. Costello et al; 3,806,056, issued Apr. 23, 1974 to Harry LaTour; 3,265,321, issued Aug. 9, 1966 to R. Rahn; and 4,288,042 issued Sept. 8, 1981 to Tadeusz Sendzimir.

These patents are mentioned as being representative of the prior art and other pertinent references may exist. None of the above cited patents are deemed to affect the patentability of the present claimed invention.

In contrast to the prior art, the present invention provides a method and apparatus for transient storing of large quantities of longitudinally advancing elongated articles such as metallic and other strip, the storage being in a single spiral coil, subsequently referred to as "accumulator coil." Said coil, having a variable number of convolutions and a variable inner and outer diameter, has means to assure that the entry and exit speeds are independently controllable, even when one of them is zero. A typical application is for feeding processing lines, such as, pickling, chromium plating, annealing, etc., which all demand that strip be fed at a uniform uninterrupted velocity. Any stoppage or even slowing down of such lines, especially the modern fast ones, causes substantial losses in material that must be scrapped and in down-time for clearing and re-starting. Since such strip is available in coils, even though some weigh twenty tons or more, periodic stoppage at the entry end of said accumulator coil for butt-welding the leading end of the next supply coil to the tail end of previous supply coil to form a continuous web, are inevitable.

The present invention represents considerable advantages over the prior art. The accumulator coil can be completely emptied so there is no need to buy a machine of larger capacity than the actual stored length required; it is also more simple because there is no need for delicate controls of velocities between the coils and the transition curve.

SUMMARY OF THE INVENTION

The invention contemplates transiently storing a variable length of strip material on a single accumulator coil rotatable about an independently rotatable cage having a welding means mounted thereon. The strip material issuing from a first supply coil, which is backed up by a reserve of one or more other coils, is guided out and wound at a controllable rate through the welding means and to the inner convolution of the accumulator coil containing a variable number of turns of variable inner and outer diameters.

The strip material is withdrawn from the outer convolution of the rotating accumulator to the downstream equipment. Upon exhaustion of the strip from the said supply coil, its trailing end is automatically clamped in fixed relative position in said welding means for welding to the leading end of the next supply coil.

Meanwhile, the cage is rotated coincidentally with and in the same rotational direction as the accumulator coil whereby continual withdrawing of the strip material results in the reduction of the number of convolutions of the latter. The leading end of the strip material of the second supply coil is directed to the welding means and fixed therein for welding the trailing and leading ends of the first and second supply coils, respectively, to form a continuous length of strip material, while the accumulator coil and the cage continue to rotate together. Following the welding operation, the joined strip is released for free travel through said guiding and welding means to the inner convolution of the accumulator coil and the rotational direction of the cage is reversed while feeding the strip material being paid off the second supply coil to replenish the depleted number of convolutions of the accumulator coil. The rotation of the cage may be stopped following said replenishment while continuing to feed the strip material being paid off the second supply coil at a rate to maintain the predetermined plurality of convolutions until exhaustion of the second supply coil. Thereupon, the cycle described above is repeated for the next supply coil.

Accordingly, it is an object of the present invention to provide a method and apparatus for transient storage of strip material which is relatively compact, requires a minimum of space, is efficient and economical.

BRIEF DESCRIPTION OF THE DRAWINGS

The invention will be more easily understood with reference to the accompanying figures wherein:

In FIGS. 1 and 2, the accumulator coil 1 is surrounded by a fixed diameter circle of rollers 2 driven by motors 3 and located in a rigid frame structure F, such as the rectangular box consisting of two rectangular frames 4, composed of structural angles, connected by two plates 5 at the top and the bottom of the frame. A pair of parallel rings 6 attached to the front and back frames 4 serve as support for the bearings 7 and motors 3 of the spaced rollers 2. Strip 8 exits from the accumulator coil 1 between two such rollers 2 and is propelled by pinch rolls 9 towards the downstream processing equipment (not shown). On the entry side, strip 8 is deposited in the inner wrap of the accumulator coil 1 from the supply coil 10 installed upon the mandrel 11 of the rotatable uncoiler. The latter is located in the axis of back plate 14 forming part of a cage structure C, and is supported in bearings 15,15' (FIG. 2). A gear 18 on the outer end of the mandrel is driven by pinion 17 on the shaft of drive motor 16. Also located in said cage is the circle of spaced inner rollers 20 together with lever and gear means for controlling the diameter of said circle, so they maintain contact with the inner wrap of said accumulator coil whose diameter is variable.

Figure 2:
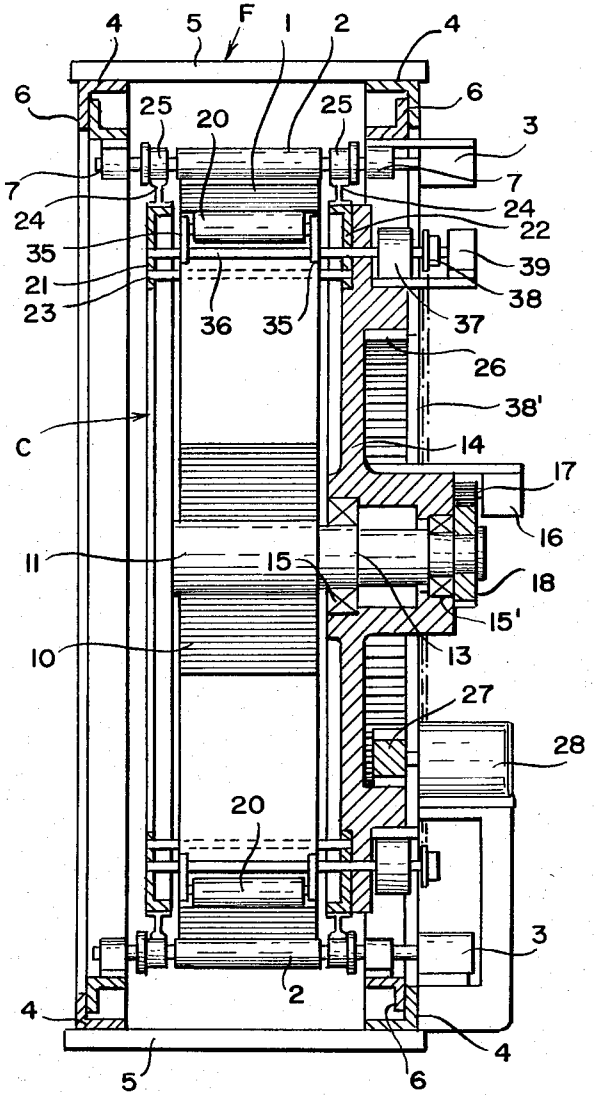
FIG. 2 is a vertical cross-section of FIG. 1.

The cage C consists of a pair of rings 21 and 22 connected by spacing members 23 to hold them coaxial and parallel and are provided with the pair of rails 24 at their peripheries which contact wheels 25, rotatably mounted on shafts of rollers 2 and the above-mentioned back plate 14 affixed to ring 22. Welder 19, which is described in detail in U.S. Pat. No. 4,129,244, Dec. 12, 1978, is also attached to back plate 14, in the path of the strip.

Reversible drive means for the cage C are shown in FIG. 2, consisting of a large gear 26 with internal teeth, which is an integral part of the back plate 14, driven by pinion 27 mounted on the shaft of the reversible and adjustable speed motor 28.

When the supply coil 10 is exhausted, its tail end is automatically gripped by the clamping finger and exit vise 91,91' (FIG. 4*a*) of the welder 19, and the cage is instantly caused to rotate together with the accumulator coil 1 to preserve an uninterrupted exit speed of strip 8.

Figure 4A:
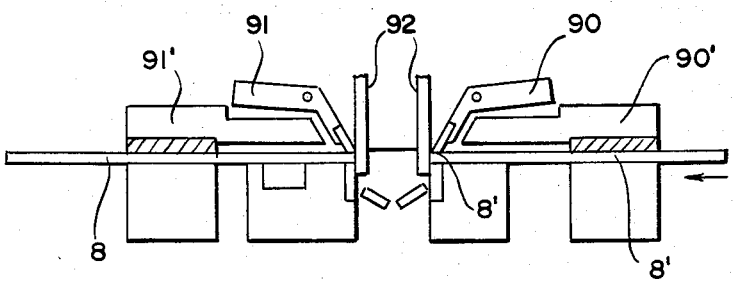
FIGS. 4*a*, 4*b* and 4*c* are schematic sections of a butt-welder for strip in three successive stages.
Figure 4B:
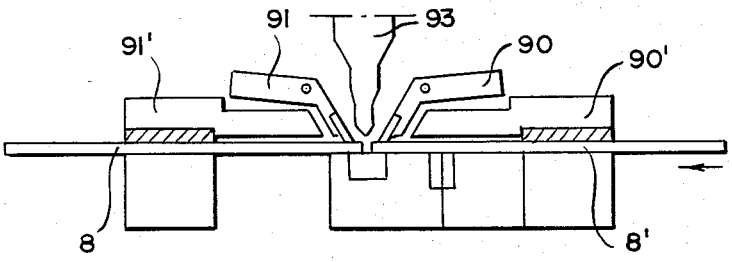

Immediately after exhaustion of the supply coil 10, a next supply coil 10' is placed on the mandrel 11 of the uncoiler which rotates to introduce the leading end of the strip through guide 29 to the pinch rolls 30 which, with the help of guide rolls 31, introduce it to the welder entry pinch rolls 32 which pull it into the welder 19, where the leading end is gripped by the clamping finger and entry vise 90,90', in correct position in relation to the other end, and welded to the tail end of the supply coil 10, (FIG. 4*b*). Thereupon, both vises open (FIG. 4*c*), and strip from the supply coil 10' is now fed into the accumulator coil 1 by welder exit pinch rolls 33, in conjunction with the above-mentioned rolls 30, 31 and 32, all working in unison together with rolls 34 to guide the strip. Also, if the rotation of the cage is reversed and accelerated, the strip is deposited at a faster rate than the exit speed so as to replenish the stored length of strip to the original length.

The above-mentioned pinch rolls 30 with guide 29, guide rolls 31, the welder 19, its pinch rolls 32 and 33 and guide rolls 34, are all affixed to the back plate 14 of the cage C described above.

The supply coil loading operation can be accomplished with the aid of a crane or a lift truck, but it is preferred that each new supply coil be inserted upon the mandrel 11 of the uncoiler with the aid of a suitable manipulator, which is both more fast and accurate and, most important, because the whole operation including installing the new supply coil, expanding the mandrel, threading the leading end into the welder 19 and starting the unwinding after joining, is accomplished by remote controls, without the need of any manual intervention by the operator.

While the accumulator coil 1 of the strip accumulator is being refilled with consecutive wraps of strip 8, its inside diameter obviously becomes smaller, and this, in turn, necessitates a gradual reduction of the diameter of the circle of the inner rollers 20. One way to accomplish this is to locate the bearings of each of said rollers 20 on a pair of arms 35, keyed unto a common shaft 36 pivotally positioned at the periphery of said cage, so that the angular position of said shafts 36 determines the diameter of said ring of rollers 20. Control of the angular position, uniformly for all said shafts 36, can be accomplished by known means, e.g., reducers known as "harmonic drives" manufactured by USM Corporation in Boston. These devices are disclosed in numerous United States patents, of which U.S. Pat. No. 2,930,254, Mar. 29, 1960, is illustrative. Such gear reducers 37, (FIG. 2), are built for ratios 100:1 or higher, so that their driving sprockets 38 can be connected and driven by one motor 39 via one common chain 38.

The travel of the strip within the accumulator coil 1, i.e., along a spiral path from the inside to the outside diameters thereof unavoidably involves a certain amount of creep between the neighboring convolutions whose length increases with increasing diameter. Friction opposes such creeping and, since it cumulates with increasing number of convolutions, it could cause the coil to become locked. This is obviated by disposing the supporting rollers 2 as well as 20 sufficiently far from one another, so that the segments of said accumulator coil comprised between each two of said rollers will sag. This causes deflection, and thus, together with the pulling force exerted on the outer wrap by the rollers 9, the locking of the accumulator coil is prevented. When utilizing strip material having a rough surface or an accumulator coil containing numerous wraps, the frictional forces between wraps may prevent or substantially inhibit the above-described creeping action. Under such circumstances, the rollers 20 which contact the inside of the accumulator coil 1, are provided with drive means (not shown) capable of exerting a negative torque on the rollers 2, i.e., opposing their rotation, so as to increase the creep between the wraps still further and produce a more "open" coil.

Figure 1:
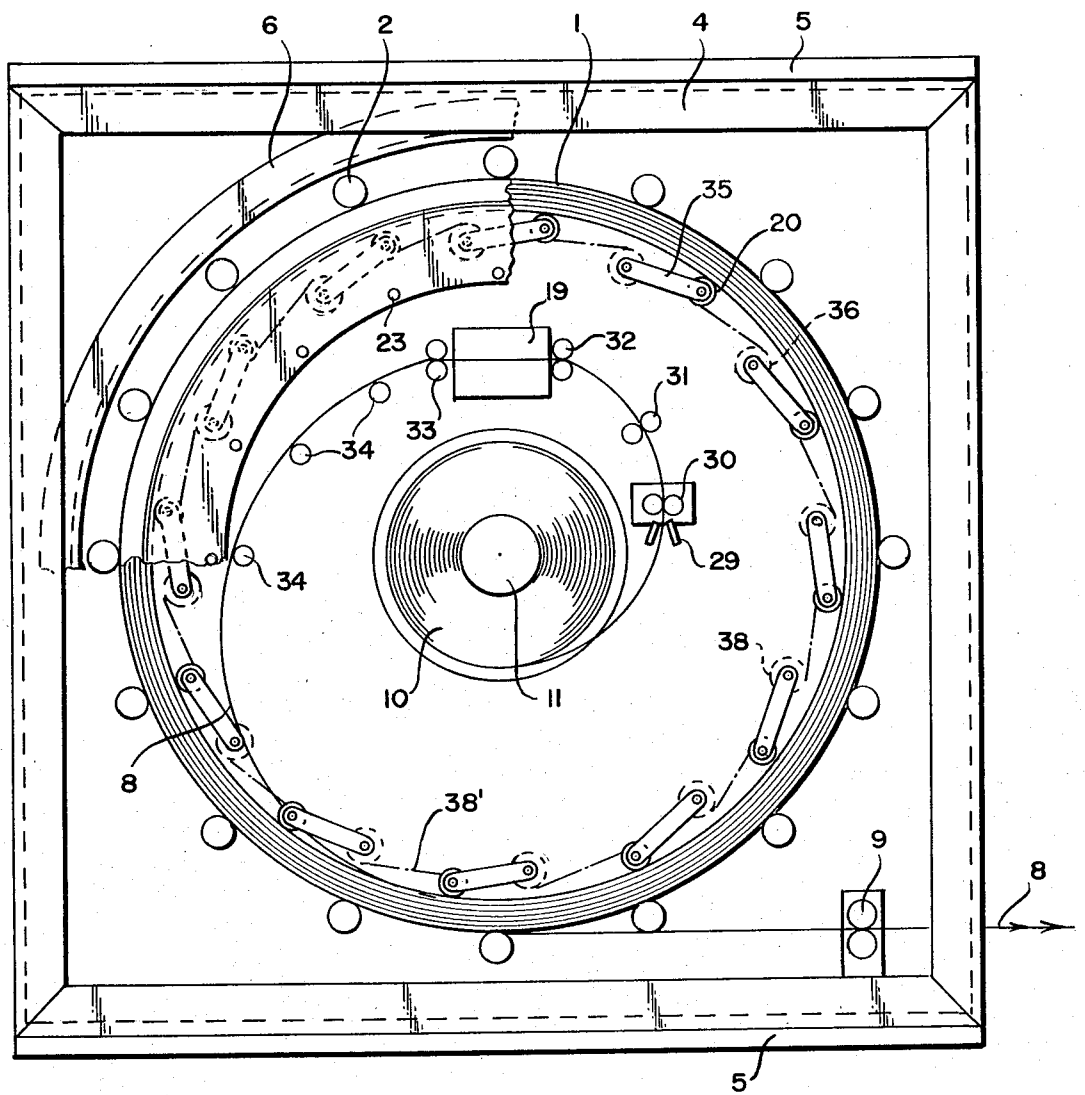
FIG. 1 is a front view, part in section, of a preferred embodiment of the invention.
Figure 3A:
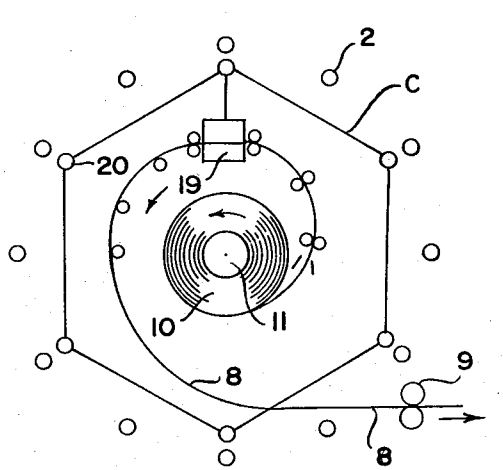
FIGS. 3*a*, 3*b*, 3*c*, 3*d* and 3*e* are schematic front views of the embodinebt shown in FIGS. 1 and 2, showing the operation of said embodiment in five successive stages.
Figure 3B:
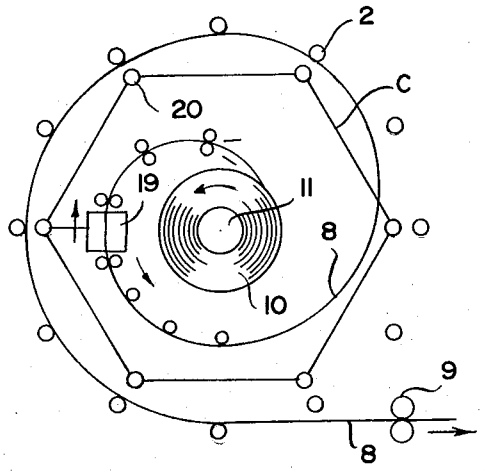
Figure 3C:
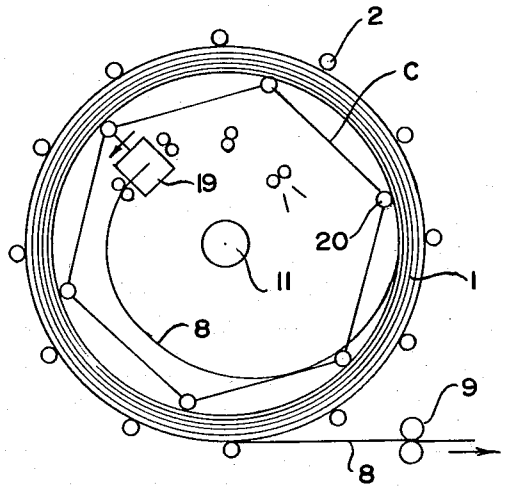
Figure 3D:
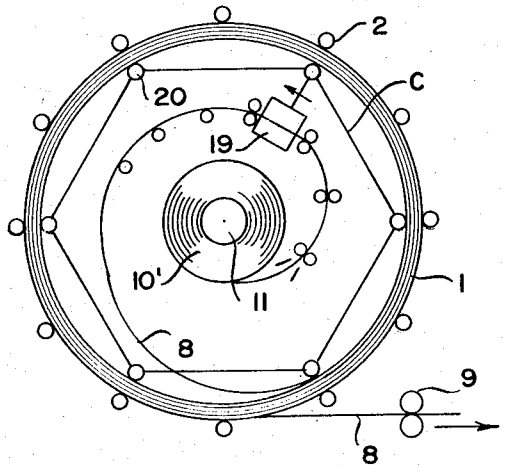
Figure 3E:
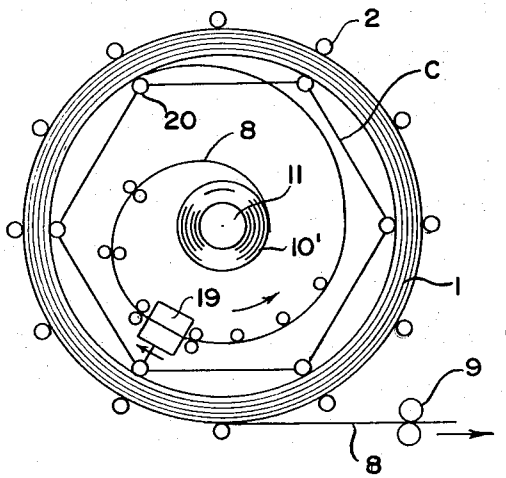

FIGS. 3*a*, 3*b*, 3*c*, 3*d* and 3*e*, show in consecutive steps, the operation of the embodiment shown in FIGS. 1 and 2. FIG. 3*a* shows the threading of the accumulator and starting of the exit rolls; FIG. 3*b* shows forming the accumulator coil by withdrawing strip from the supply coil; FIG. 3*c* shows rotating the cage with the tail end of supply coil gripped; FIG. 3*d* shows threading the new supply coil and joining the first coil; and FIG. 3*e* shows replenishing the accumulator coil.

In FIG. 3*a*, the first supply coil 10 has been mounted on the mandrel 11 and the leading end of the strip 8 from the supply coil 10 is threaded through the welder 19, through the exit pinch rolls 9 and is being advanced into processing line (not shown), thus gradually depleting the supply coil 10. The cage C remains stationary. In FIG. 3*b*, strip 8 continues to advance to the processing line, while strip is unwound from the supply coil at a velocity higher than the exit speed, thus forming convolutions of the accumulator coil, while cage C with welder 19 and inner rolls 20 affixed to it, rotates clockwise. This operation continues until the exhaustion of the supply coil 10.

FIG. 3*c* shows the accumulator coil full, and supply coil exhausted, its tail end gripped by the exit pinch rolls of the welder instrumentality 19, and of course cage C rotating counterclockwise with the strip so gripped. Each revolution of the cage depletes the accumulator coil by one wrap.

FIG. 3*d* shows the new supply coil 10' already mounted on the mandrel and its leading end gripped in entry vise of the welder 19 and being welded to the tail end of previous supply coil 10. On completion, both gripping devices of the welder are released. This permits the reversal of the cage C and the withdrawal of the strip from the new supply coil. In order to replenish the partly depleted accumulator coil, cage C is now again caused to rotate clockwise, the speed of rotation exceeding the exit speed sufficiently to complete replenishing the accumulator coil well before exhausting the supply coil, (FIG. 3*e*).

Figure 4C:
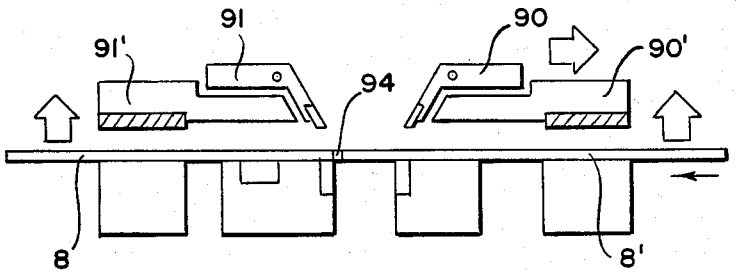

When the coil ends are both clamped by the vises they are in position for the shearing of the scrap ends by the shearing blades 92 as shown in FIG. 4*a*. Upon withdrawal of the shearing blades, the clamps release and the exit shear block indexes to weld position followed by the forward indexing of the entry clamp and sheared coil end 8' to form a butt or gap joint. The clamping fingers 90 and 91 close preparatory to the advancement of the torch 93 of the arc welding device as shown in FIG. 4*b*. Upon the advancement of the torch to the strip edges, the arc is ignited and the torch traverses the strip, completing the weld. Thereafter, the fingers release, the clamps are raised, the torch returns to start position, the entry clamp and exit shear block return to shear position, all as shown in FIG. 4*c*. The total time required for clamping, shearing and indexing a strip 36" wide, is approximately forty-five seconds.

The machine executing the above described operation is known in the industrial fields as a Guild Zipwelder, which is illustrated in the brochure distributed by Tesgo, Inc., 5833 Royalton Road, N. Royalton, Ohio 44133, a copy of which is annexed to the instant application.

A more detailed disclosure of the strip shearing and joining device may be found in the above-mentioned U.S. Pat. No. 4,129,244, Dec. 12, 1978, assigned to Guild International, Inc.

During the welding procedure the cage C continues to rotate counterclockwise synchronously with the accumulator coil 1 while the number of convolutions of the accumulator coil 1 is reducing. Immediately after welding is completed the replenishing of the convolutions of said accumulator coil 1 follows, shown in FIG. 3*e*. Both vises of the welder 19 are open and strip starts being unwound with the velocity higher than that of the exit pinch rolls 9, from the second supply coil 10' rotating counterclockwise, causing the cage C to reverse its rotation again to clockwise and replenishing accumulator coil 1 to the full capacity of the accumulator.

The butt-welder 19 may be of a conventional design, other than the Guild Zipwelder discussed above and described in U.S. Pat. No. 4,129,244.

Figure 5:
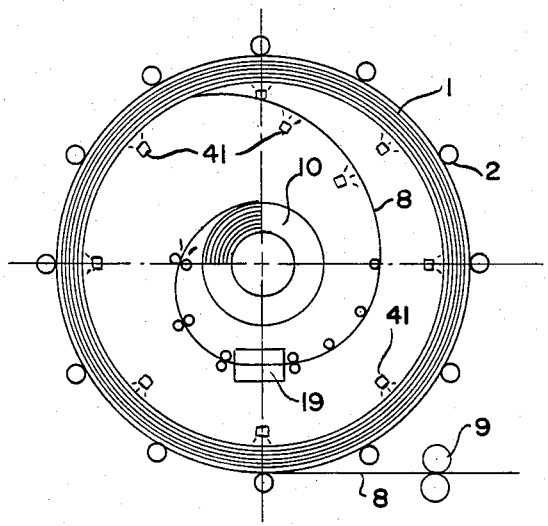

The embodiment shown in FIG. 5 differs from FIGS. 1 and 2 in that the inner rollers 20 are omitted. Centrally located uncoiler feeds the strip out of the supply coil 10 to the inner wraps of accumulator coil 1. This embodiment is particularly suitable for strip of heavier gauges whose weight and rigidity are sufficient for the centrifugal force exerting upon the part of the strip 8 between welder 19 and the inner wrap of the accumulator coil 1 to throw the strip against the inner wraps of accumulator coil 1, if necessary with the aid of suitably placed air jets 41 exerting air pressure upon the above-described part of the strip and the inner wrap of the accumulator coil 1 in a direction to aid said centrifugal force and facilitate the formation of new inner wraps.

Upon exhaustion of supply coil 10, its tail end is gripped by the exit vise of welder 19 causing the cage to rotate with the accumulator coil, in similar manner as in the operation of the accumulator of FIGS. 1 and 2. A new supply coil is then mounted and butt-welded, and, the rotation of the cage is reversed to fill the accumulator coil 1 to capacity.

Figure 6:
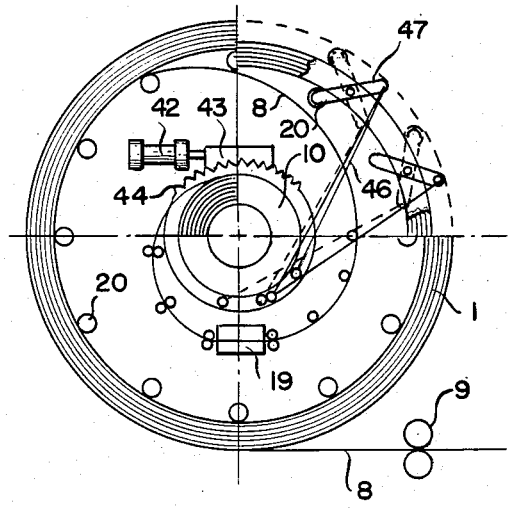
FIGS. 5 and 6 are schematic front views of two other embodiments of the invention.

The arrangement shown in FIG. 6, while capable of being operated in a manner as described above where a certain creep takes place on the interfaces between the wraps of the accumulator coil, is also capable of being operated in another manner, namely, passing the strip through the accumulator coil while avoiding the slightest relative movement or creeping of one convolution against the other.

Such creeping is indispensable for operation according to FIGS. 1 and 2 as has been explained above. Yet on strips of some metals and particularly on soft metals with a highly polished surface, dust and other particles which may enter between the successive wraps of the accumulator coil, might produce unacceptable scratches. To accomplish such non-creeping accumulator coil operation, an accumulator coil 1 is first built up containing ten convolutions or so, so that the accumulator coil is "locked" by inner friction. Rollers 20 are, for this purpose, more closely spaced to prevent the accumulator coil 1 from sagging between the rollers 20. Moreover, the mechanical expanding mechanism as shown in FIGS. 1 and 2 for the circle of supporting rolls 20 must be converted to a pneumatic or equivalent actuation so that these rolls exert a steady pressure upon the innermost convolution of the accumulator coil. In FIG. 6 is shown an air cylinder 42 exerting steady pressure on a rack 43 which is transmitted through rollers 20 to the innermost convolution of the accumulator coil 1 through gear disc 44 and lever linkages 46 and 47.

Strip is fed out of the outer convolution of the accumulator coil 1 by pinch rolls 9 and this reduces the outer diameter of the accumulator coil, since the locked accumulator coil rotates as a solid ring. Likewise, a new layer added to the inner convolution of the accumulator coil 1 reduces the inside diameter of the accumulator coil. Obviously, the operation may proceed only until the minimum diameter of the circle of inner rollers 20 is reached for which the machine has been designed. With the inner rollers 20 being disposed at their predetermined minimum diameter the accumulator functions as follows:

The strip continues to exit out of the outer convolution to feed the downstream equipment, while feeding from the supply coil 10 is stopped. This gradually reduces the number of convolutions in the accumulator coil and when only three or two are left, the coil suddently "unlocks" itself and the ring of inside rollers 20 is now free to expand to the maximum accumulator coil diameter for which the accumulator has been designed. Since the diameter controlling mechanism encounters practically no resistance, such expansion is almost like a jump from the smallest to the largest diameter. This is the only moment when a relative movement of one wrap against another takes place, but at that moment there is practically no load on them, there being only two or three wraps in the coil, so generally no scratches will occur.

Alternatively, the ring of the inside rollers 20, if expandable by the mechanism shown on FIGS. 1 and 2, i.e., motor and harmonic drive, can be held at minimum diameter until the accumulator coil is reduced to only one wrap and then be quickly expanded to maximum diameter, thus eliminating any relative movement between the wraps. At approximately the time when the inside rollers 20 are being expanded, the supply coil 10 is caused to start replenishing the accumulator coil 1 as described previously.

Figure 7:
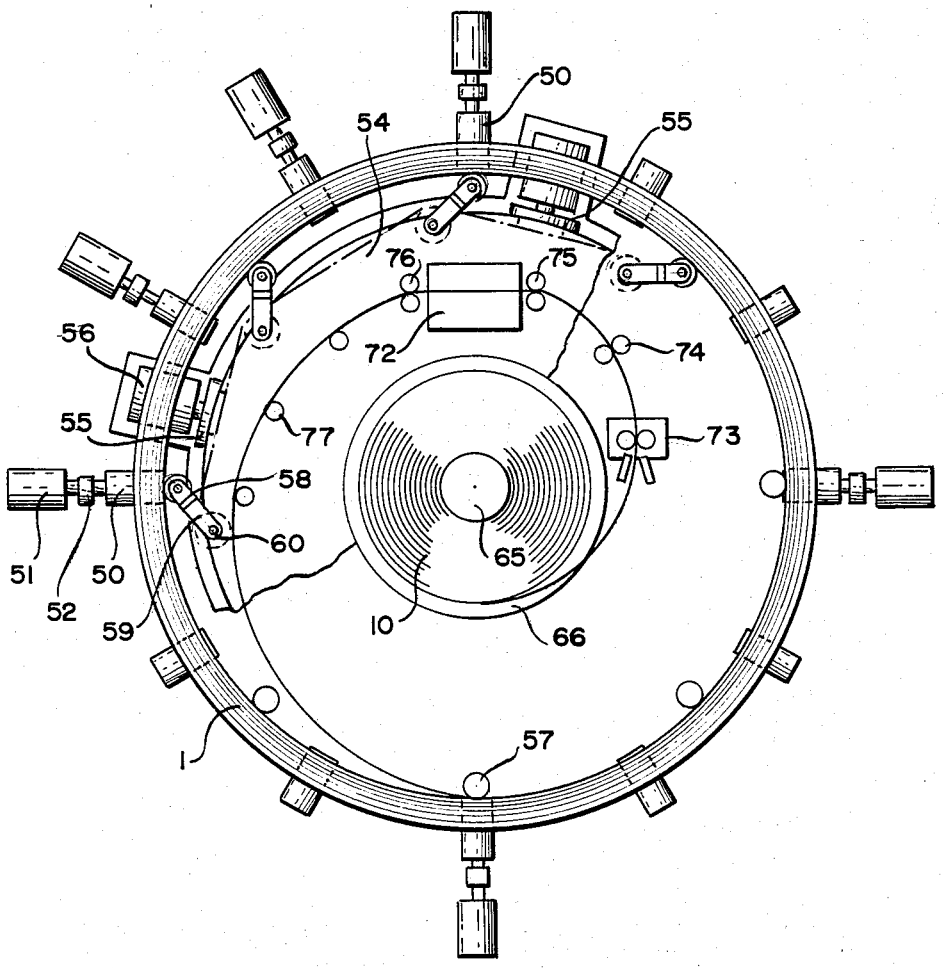
FIG. 7 is a plan view of an accumulator coil operating on a vertical axis.
Figure 8:
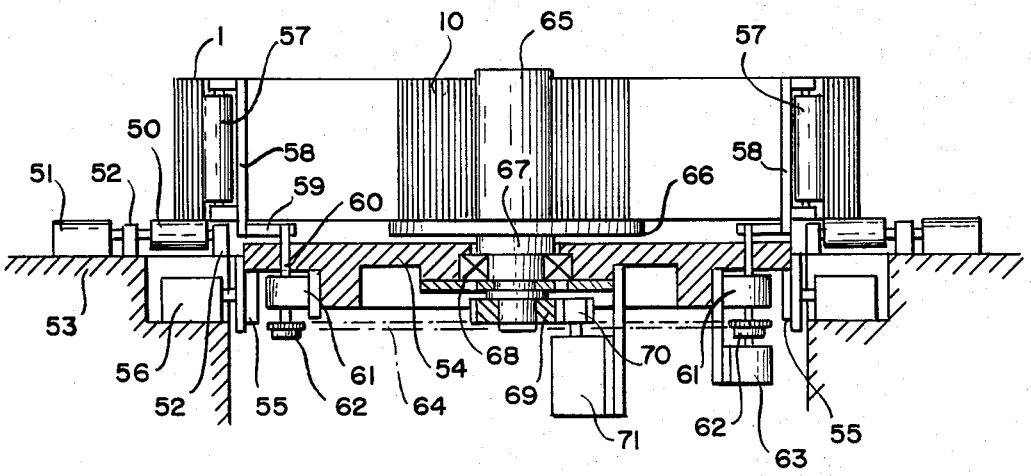
FIG. 8 is a vertical cross-section of FIG. 7 with some parts in elevation.

The embodiment shown in FIGS. 7 and 8 closely resembles that of FIGS. 1 and 2 except that the axis of the accumulator coil 1 is vertical, the strip being in an "on edge" attitude which is preferable in some instances. The edges of accumulator coil 1 are supported and propelled by a plurality of radially disposed rollers 50, each driven by motor 51, and having their respective bearings 52 affixed to the base 53 of the accumulator. Cage 54 is a circular platform coaxial with the accumulator coil 1 and supported by wheels 55 affixed to the base 53 and driven by motors 56. The inside rollers 57 are of course vertical and are also affixed to cage 54 through their brackets 58. The diameter of the circle of rollers 57 is controlled in the same manner as the one shown in FIGS. 1 and 2 and described previously. The mechanism consists of arms 59 with their shafts 60 pivotally positioned in cage 54. The angular position of the shafts 60 and therefore the diameter of the circle of the inside rollers 57 is controlled by gear reducers 61, to the input of which, chain sprockets 62 connected by chain 64, are driven by common motor 63 (FIG. 8).

The uncoiler consists of expanding mandrel 65 affixed to circular plate 66, with shaft 67 rotatably mounted in the cage 54 by means of bearing 68. The uncoiler is coaxial with the accumulator coil 1 and cage 54, to facilitate safe loading of the new supply coils even when the cage 54 is rotating. The uncoiler is driven in the same manner as the uncoiler shown in FIGS. 1 and 2. The drive means consists of gear 69, pinion 70 and motor 71. The welder 72, pinch rolls 73, guide rolls 74, welder pinch rolls 75 and 76 and guide rolls 77 and all affixed to the cage in the same manner as in FIGS. 1 and 2 and operate in the same manner.

Figure 9:
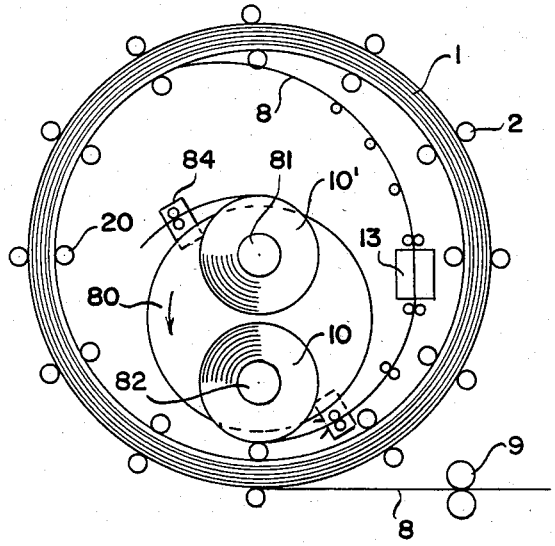
FIG. 9 is a front elevation of a variant embodiment of the invention shown in FIG. 1.

The embodiment shown in FIG. 9 differs from FIG. 1 only in that the singular uncoiler accepting supply coils 10 is replaced with the carousel uncoiler 80. This embodiment is particularly suitable if the supply coils are small, allowing limited time for mounting of new supply coils while the time for welding remains the same.

The carousel uncoiler 80 is pivotally attached to the back plate 14 of the rotating cage and is provided with drive means. The pivot is so disposed off center or eccentric to the axis of the cage so that mandrel 81 is located in the axis of the accumulator coil 1 to facilitate safe loading of the new supply coils even when the cage is rotating. Such uncoilers are well known in the industrial arts, and one is shown, for example, in FIG. 7 of the above-mentioned U.S. Pat. No. 3,310,255 to Sendzimir.

The strip 8 exits from the accumulator coil via pinch rolls 9 towards the downstream processing equipment while on the entry side, the strip 8 is fed from the supply coil 10 on mandrel 82, through butt-welder 19 to the inner wrap of the accumulator coil 1. When the supply coil 10 is exhausted and its tail end is gripped in the exit vise of the welder 19, the carousel uncoiler 80 is rotated 180° in order to place the new supply coil 10' in an uncoiling position. Its leading end, previously straightened by inching rolls 84, is pulled into the welder and is welded to the tail of the previous supply coil 10, as described above, which is followed by the replenishing of the accumulator coil 1. The empty mandrel 82 of the carousel uncoiler 80 is now centrally located and can be loaded with the next supply coil while the cage is rotating.

The cage, outside rollers 2, inside rollers 20 and all other mechinisms of the embodiment shown in FIG. 9 are the same and operate the same as those shown in FIGS. 1 and 2.

As used throughout the claims, the term welding in addition to its usual and customary meaning shall mean joining of strips of material by any means.

While the invention has been described with respect to several preferred embodiments, it should be apparent to those skilled in the art that numerous modifications may be made thereto without departing from the spirit and scope of the invention.

We claim:

1. The method of intermittently replenishing a high-capacity single accumulator coil of strip material, wherein the strip is fed from a supply coil into the innermost convolution of the accumulator coil and is withdrawn from the outermost convolution thereof to provide a continuous supply of the strip to downstream equipment, which includes (a) the step of joining the leading end of strip material in a second supply coil to the tail end of said first-mentioned supply coil upon its exhaustion, while said ends are fixed in a joining device on a rotary cage within said accumulator coil adapted to rotate with the latter to offer no impediment to the rotation thereof and the withdrawal of the outer convolutions being delivered to the downstream equipment, and (b) reversing the rotation of said cage upon completion of said joining of said ends and the resumption of travel of said strip material from said second supply coil, to build up the inner convolutions at a rapid rate and to the desired number of convolutions of said accumulator coil.

2. The method set forth in claim 1, wherein the cage is rotated synchronously and in the same direction as the accumulator coil during the joining operation and is rotated in the reverse direction thereafter to accelerate the build-up of the inner convolutions to the desired capacity.

3. The method set forth in claim 1, including the step of exerting mechanical pressure against the inner convolutions of the strip material in the accumulator coil following their disposition against the preceding turns thereof.

4. The method set forth in claim 1, including the step of exerting pneumatic pressure against the inner convolutions of the strip material in the accumulator coil following their disposition against the preceding turns thereof.

5. The method set forth in claim 1, including the step of rotating said cage at a speed different from the accumulator following the splicing operation, to control the relative length of the strip fed from the supply coil to the innermost convolution thereof and that discharged from its outermost convolution.

6. An apparatus for intermittently replenishing a high-capacity single accumulator coil of strip material furnishing a continuous supply of the strip to downstream equipment, comprising (a) supporting means for a single rotating accumulator coil of a variable number of convolutions and variable inner and outer diameters adapted to receive the strip at its innermost convolution and to discharge the strip from its outermost convolution, (b) means adjacent to said accumulator coil for uncoiling a supply coil of strip material for transfer of the strip therefrom to the innermost convolution of the accumulator coil, (c) an independently rotating cage relative to and within said supporting means and accumulator coil, (d) joining means mounted on said cage between the output of said supply coil and the innermost convolution of said accumulator coil comprising means for clamping the tail end of the strip issuing from said supply coil upon its exhaustion, (e) means for mounting a second supply coil in proximity to said accumulator coil adapted to have the leading end thereof directed to said joining means for clamping therein preparatory to joining said two ends together, and (f) means for releasing the ends of said strip following their juncture to permit the delivery of the strip from said second supply coil for guidance to the inner convolutions of said accumulator coil while the withdrawal of the outer convolutions therefrom continues.

7. An apparatus as set forth in claim 6, wherein said strip material is metallic and said joining means is a butt-welding apparatus.

8. An apparatus as set forth in claim 6, including means for rotating said cage in the same direction as said coil during the clamping and joining operations of said strip and to stop said rotation following the release of the strip for travel between the second supply coil and accumulator coil.

9. An apparatus as set forth in claim 6, including means for rotating said cage in the same direction as said coil during the clamping and joining operations of said strip and to reverse said rotation following the release of the strip for travel between the second supply coil and accumulator coil to accelerate the delivery of the strip to the inner convolution of said accumulator coil until the desired capacity of the latter is attained.

10. An apparatus as set forth in claim 6, wherein said supporting means for the accumulator coil comprises (a) a frame, (b) a plurality of circumferentially arranged outer rollers rotatably mounted in said frame for contact with the outermost convolution thereof, (c) a ring of inner rollers rotatably mounted in said cage and distributed circumferentially therein for contact with the innermost convolution thereof, and (d) means for adjusting the radial spacing between said outer and inner rollers to provide space for a variable number of convolutions.

11. An apparatus as set forth in claim 10, including drive means for at least one of said outer rollers.

12. An apparatus as set forth in claim 10, wherein said last-mentioned means comprises a pivoted lever system for mounting each of said inner rollers and means for controlling the angular position of each of said levers in unison.

13. An apparatus as set forth in claim 12, wherein said last-mentioned means comprises a common actuator therefor.

14. An apparatus as set forth in claim 13, wherein said common actuator is a harmonic drive mechanism.

15. An apparatus as set forth in claim 6, wherein said accumulator coil is mounted on a horizontal axis with adjustable spacing between said inner rollers to control the sagging of the strip therebetween and thereby the creeping between the adjacent convolutions.

16. An apparatus as set forth in claim 6, including means for controlling the reversal of rotation of the inner rollers to control the creeping action between adjacent convolutions.

17. An apparatus as set forth in claim 12, including gearing connected to said last-mentioned means for exerting mechanical pressure against the innermost convolutions of the accumulator coil.

18. An apparatus as set forth in claim 6, including pneumatic blowing means acting against the joined strip during its passage and arrival to the innermost convolution, in supplement to the centrifugal force acting thereon.

19. An apparatus as set forth in claim 6, wherein the rotating accumulator coil and rotating cage are on a common axis, including means for mounting said uncoiling means on said axis.

20. An apparatus as set forth in claim 19, wherein said uncoiling means comprises a rotary expanding mandrel mounted on the base of said cage and independently rotatable thereon.

21. An apparatus as set forth in claim 19, wherein said last-mentioned means comprises a circular carousel uncoiler pivotally mounted on the base of said cage eccentrically of the axis of the latter, a pair of diametrically displaced rotary mandrels mounted on said uncoiler, with the outermost one adapted to mount said first supply coil for furnishing the strip material to the innermost convolution of the accumulator coil while the second mandrel is in alignment with the rotary axis of said cage and thereby in position to receive the second supply coil while the cage is rotating, preparatory to its shifting 180° to position the second mandrel in the position previously occupied by the first mandrel so that the leading edge thereof may be guided for joining to the tail end of the first supply coil in consequence of its exhaustion.

* * * * *